United States Patent [19]

Boote et al.

[11] Patent Number: 4,632,326

[45] Date of Patent: Dec. 30, 1986

[54] COIL HANDLING APPARATUS

[75] Inventors: Robert A. Boote, Ithaca; Timothy G. Meddaugh, Candor, both of N.Y.

[73] Assignee: Emerson Electric Co., St. Louis, Mo.

[21] Appl. No.: 772,136

[22] Filed: Sep. 3, 1985

[51] Int. Cl.[4] ..... B21C 47/18

[52] U.S. Cl. ..... 242/55.3; 242/68.7; 242/78.7; 242/78.8; 414/332; 83/650

[58] Field of Search ..... 83/650; 242/68.7, 55.3, 242/55.53, 86.52, 78.7, 78.8; 414/332, 573; 269/9, 56, 58, 289 MR, 903

[56] References Cited

U.S. PATENT DOCUMENTS

| | | | |
|---|---|---|---|
| 661,114 | 11/1900 | Williams | 242/55.3 |
| 1,927,976 | 9/1933 | Evans | 83/650 |
| 2,267,175 | 12/1941 | Skriba | 242/78.7 |
| 2,660,381 | 11/1953 | Friedl et al. | 242/68.7 |
| 2,692,737 | 10/1954 | Rowe | 242/78.7 |
| 2,833,489 | 5/1958 | Hall | 242/78.7 |
| 2,957,638 | 10/1960 | Schiller et al. | 242/55.53 X |
| 3,048,347 | 8/1962 | Edmonds | 242/78.7 |
| 3,079,827 | 3/1963 | Castelli | 83/650 |
| 3,103,322 | 9/1963 | Garner | 242/68.7 X |
| 3,472,463 | 10/1969 | Fedor et al. | 242/78.7 |
| 3,507,178 | 4/1970 | Lamon et al. | 83/650 |
| 3,823,629 | 7/1974 | Bleimund | 83/650 |

*Primary Examiner*—Horace M. Culver
*Attorney, Agent, or Firm*—Aubrey L. Burgess

[57] ABSTRACT

A coil handling apparatus for association with a punch press in which a series of side-by-side cradle devices, each comprising a pair of spaced rigid plates with rollers therebetween, support a coil of strip material permitting the coil to rotate as strip material is removed therefrom, and means to clamp the free end of the strip material when material is not being removed from the supported coil.

3 Claims, 7 Drawing Figures

COIL HANDLING APPARATUS

BACKGROUND OF THE INVENTION

This application relates to apparatus for handling coils of strip materials, such as strip steel or other metals, and is particularly usable in a manufacturing process wherein strip steel is fed to a punch press for making links for various types of chain.

Metal strip is purchased in banded coils, and for use, a coil is placed in a holder, unbanded, and then fed from the coil to the punch press. Strip material in coils is available in various widths and thicknesses depending upon the particular product to be manufactured. In the manufacture of chain, there may be short production of some links, and it is common practice to process a full coil of material, even though not needed, to avoid rebanding the partial coil. Rebanding a partial coil is a time consuming and sometimes dangerous procedure. By processing a full coil when the punched part is not needed, stock of the parts is increased and inventory carrying costs are incurred. Some parts may never be used and eventually find their way to the scrap heap to be sold as scrap at a much lesser price than that paid for coiled material.

SUMMARY OF THE INVENTION

According to this invention, a coil handling apparatus is provided which is capable of handling multiple coils of material, either as full or partial coils and of the same or different widths and/or thicknesses. The coil handling apparatus is movable to position the coiled material in the proper location for feeding the same to the punch press. Also provided is a means to clamp the free end of a coil to prevent uncoiling, especially after unbanding a full coil and/or after partially using a coil. The use of the apparatus of this invention eliminates the need to use a full coil of material for a short production run of one particular part, eliminates the rebanding of a partial coil, and also provides a means for quickly changing from one width and/or thickness and/or material to another when desirable or necessary due to production demands.

While the coil handling apparatus finds particular use with apparatus for punching links to be assembled into chain, the coil handling apparatus of this invention can be used in other manufacturing processes wherein the same or similar conditions are encountered.

More particularly, the coil handling apparatus comprises a series of subassemblies in the form of rigid plates, spaced by supporting means and having a plurality of rollers journaled therebetween. The rollers are arranged in a generally circular pattern and are provided to support a coil of material between the plates, permitting the coil to rotate to provide an easy feed of the strip material from the coil. A series of the subassemblies are supported on a wheeled frame for movement along a predetermined path, such as provided by a rail or track. By moving the wheeled frame along the path, a coil of material is aligned with a feeding mechanism for feeding the strip to the press. In the event that the production run of the part does not use a full coil, the free end of the coil is retained by pinch rolls on the subassembly, so that the remainder of the coil can be used at a different time and perhaps for a different part.

DETAILED DESCRIPTION OF THE PREFERRED EMBODIMENT

Figure 1:
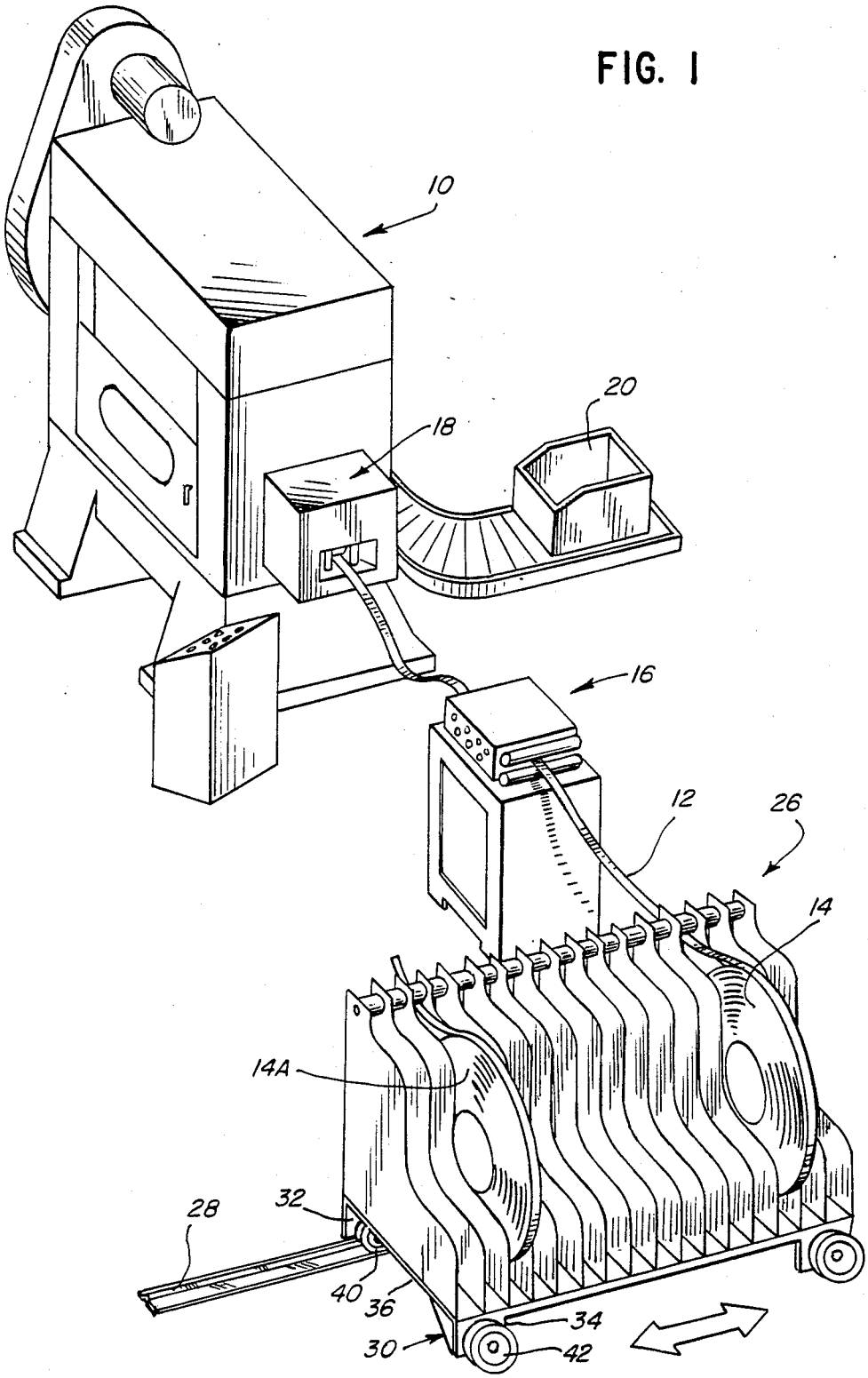
FIG. 1 is a pictorial view of apparatus for punching or blanking links for chains from coiled strip material, showing the coil handling apparatus of this invention.
Figure 2:
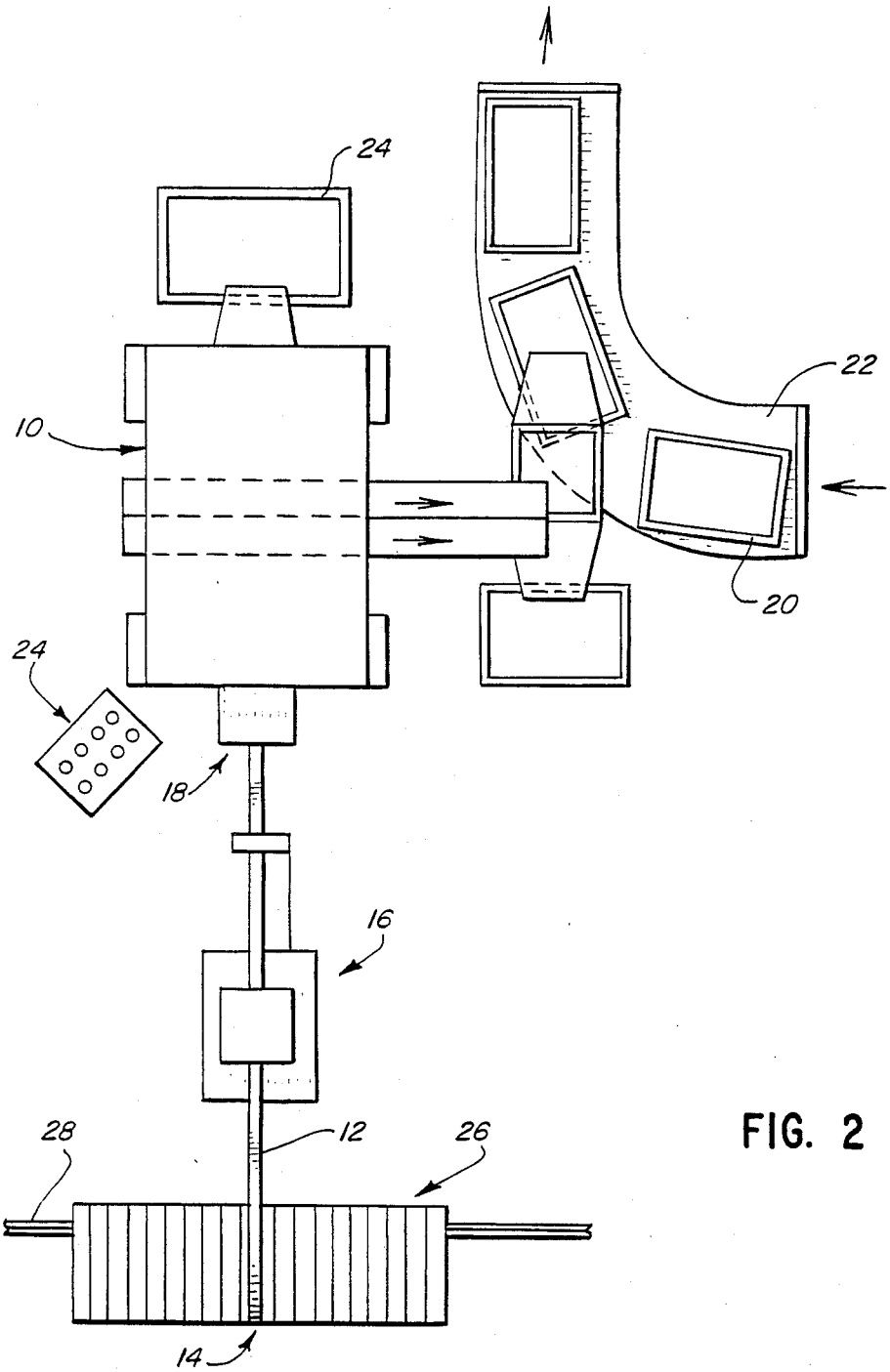
FIG. 2 is a schematic plan view of the apparatus of FIG. 1.

Looking at FIGS. 1 and 2 of the drawings, there is shown a punch press 10 to which is fed a strip 12 of material from a coil 14 of the material through a stock straightener 16 and a stock feeder 18, the punched-out parts, such as chain links, being discharged into bins 20 on a conveor 22. The apparatus is controlled by an operator from a control panel 24. The punch press 10, the stock straightener 16 and the stock feeder 18, as well as the bins 20 and conveyor 22, are conventional and need no further description. Scrap is discharged from the press 10 into a scrap hopper 24.

The coil 14 of strip material is supported in a coil handling apparatus 26 together with other coils 14A, 14B, 14C, etc. of material in side-by-side relationship. The coil handling apparatus is constructed to be movable transversely of the punch press in order that the desired coil of material is properly positioned for feeding to the press. For this purpose, a rail 28 is provided, the rail being connected to the floor of the factory or to another suitable support. Means to be later described is provided whereby the operator can position the coil handling apparatus at its desired location with respect to the press for feeding the strip material to the press.

Figure 4:
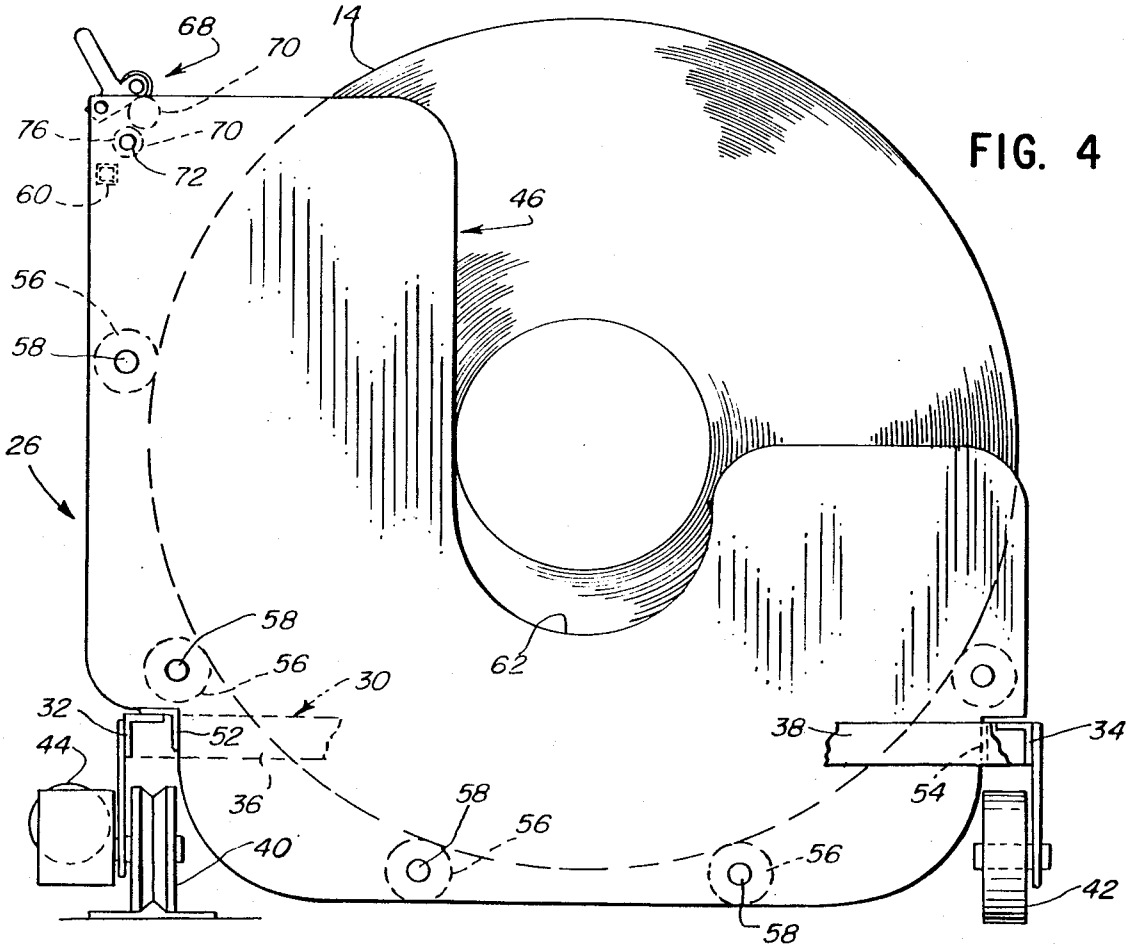
FIG. 4 is a side view of the apparatus of FIG. 3 indicating in broken lines a supported coil of strip material.
Figure 3:
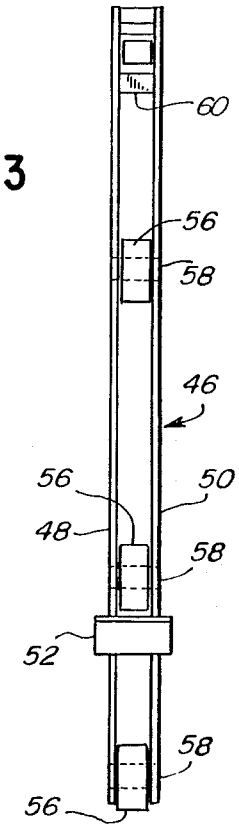
FIG. 3 is a frontal view of a portion of a coil handling apparatus constructed according to this invention.

The coil handling apparatus 26 is shown in more detail in FIGS. 3 and 4 and comprises a frame 30 having generally parallel front and rear members 32 and 34, and end members 36 and 38. The front member 32 supports a plurality of spaced V-grooved wheel 40 for rolling along the rail 28, while the rear member 34 supports a plurality of wheels 42 for rolling along the floor or supporting surface, as the case may be. A relatively small, reversible motor 44 and a connected speed reducer are supported by the front member 32 and the motor/speed reducer shaft is connected to one of the wheels 40, so as to provide the power to drive the wheel 40 and the frame 30 along the rail 28. The motor/speed reducer 44 is electrically connected to the control panel 24 and provides the means whereby the coil handling apparatus is moved to and from the desired position under the remote control of the operator.

A plurality of coil supporting assemblies or cassettes 46 are supported on the frame 30, as being bolted or otherwise secured, and each coil supporting assembly 46 comprises a pair of spaced, generally L-shaped rigid plates 48 and 50 forming the sides of the cassette. The plates are spaced by front and rear angle members 52 and 54 which extend beyond the outside surfaces of the plates 48 and 50. A series of rollers 56 is arranged in a generally circular pattern between the plates 48 and 50, and each roller is journaled on a shaft 58 supported by the plates 48 and 50. The angle members 52 and 54 not only support the assembly of plates and rollers on the frame, but by abutting similar parts of the next adjacent subassembly so supported, space the subassemblies one from another. An additional spacer 60 is used to insure the uniform spacing of the plates 48 and 50.

A cut-out 62 in the form of a segment of a circle is provided at the juncture of the legs of each plate for receiving the hubs of coils 14, 14A, 14B, 14C, etc. of material. The rollers 56 support the outside of a coil and permit the removal of material therefrom. Each subassembly of plates is fastened to the frame as by being bolted or otherwise secured thereto (not illustrated), thus making it possible to remove one or more subassemblies and replace it or them with subassemblies constructed to support different widths of material, or merely with a different material. Coils of material can be unbanded and placed in a cassette for future use.

A pinch roll device 68 (see also FIG. 8) is incorporated in each coil handling assembly 46 for retaining the free end of the strip material after the coil 14 is disbanded or after the coil is partially used. The pinch roll device 68 comprises a roller 70 journaled on a shaft 72 supported by a pair of plates 48 and 50, and a T-shaped lever 74 supported on a pin 76, also supported by a pair of spaced plates 48 and 50. The pin 76 suppots a roller 77 and the lever 74 carries a pinch roll 78. The strip material is fed across the rollers 70 and 77 to the feeder 18; at the termination of its use, the lever is pivoted, bringing the roller 78 into engagement with the strip material and restraining its movement until its next use.

Figure 5:
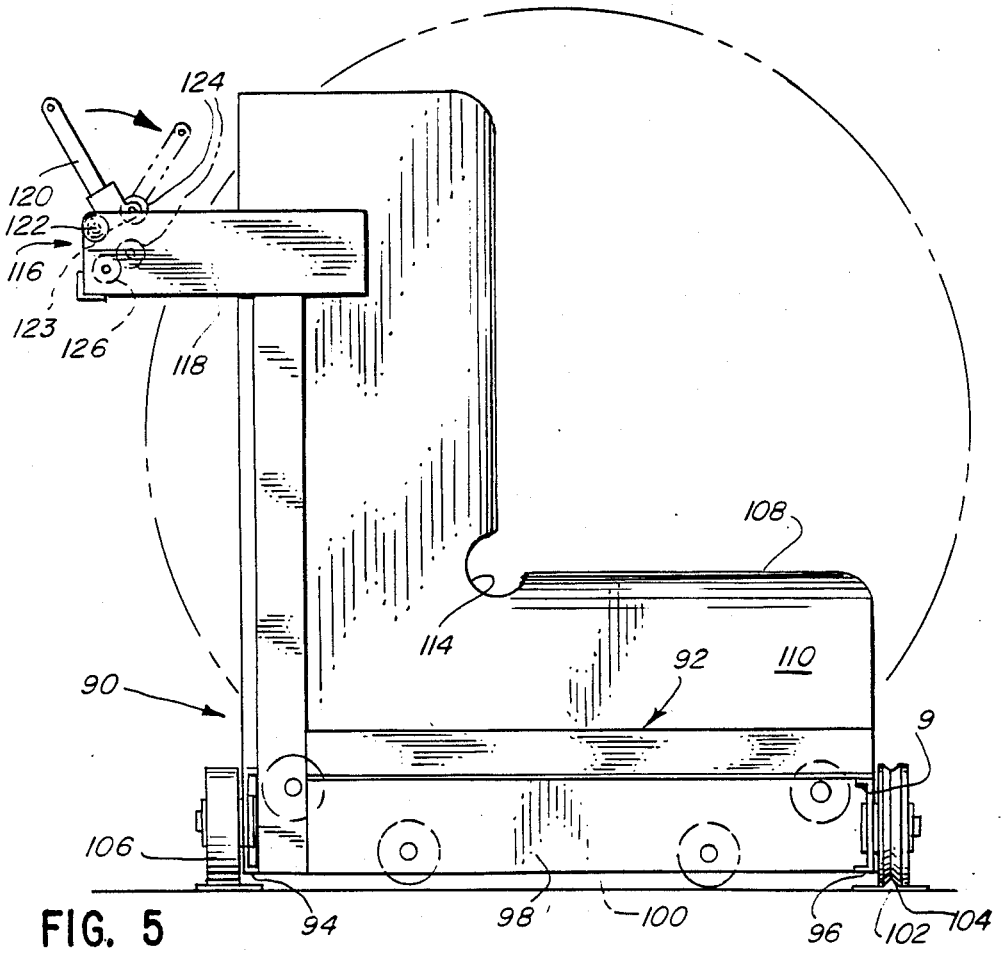
FIG. 5 is a side view of another form of apparatus similar to that shown in FIG. 4 indicating in broken lines a supported coil of strip material.
Figure 6:
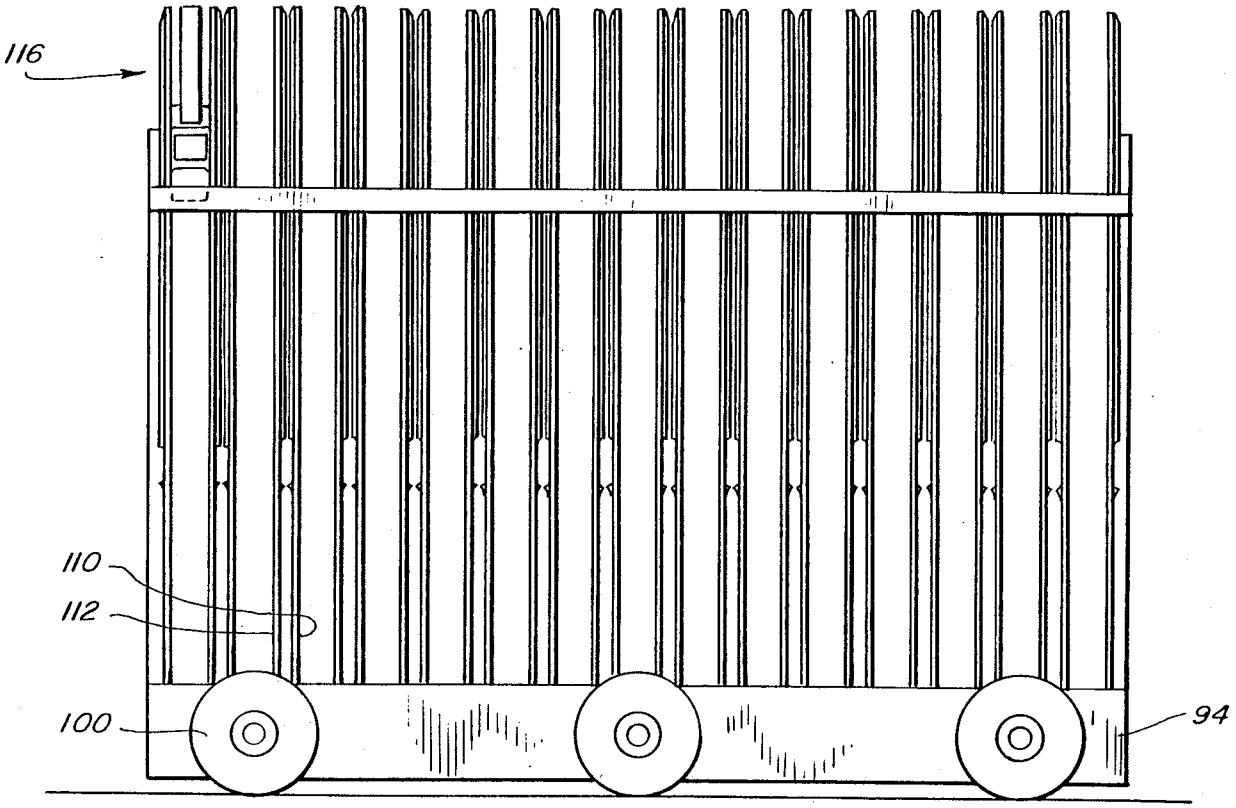
FIG. 6 is a front view of the apparatus of FIG. 5.

In a second embodiment, illustrated in FIGS. 5 and 6, the coil handling apparatus, identified as 90, is formed as an integral unit with a frame 92 composed of front, rear and end members 94, 96, 98 and 100, with spaced grooved wheels 102 journaled from the rear member 96, so as to be movable along a rail 104. Wheels 106 are journaled from the front member 94, so as to roll along a surface, such as the plant's floor.

A series 108 of spaced pairs of rigid supporting plates 110 and 112 are joined to the members 94 and 96 and each is generally L-shaped with a cut-out 114 in the form of a segment of a circle at the juncture of the legs of the L to receive the hub of a coil of strip material.

Figure 7:
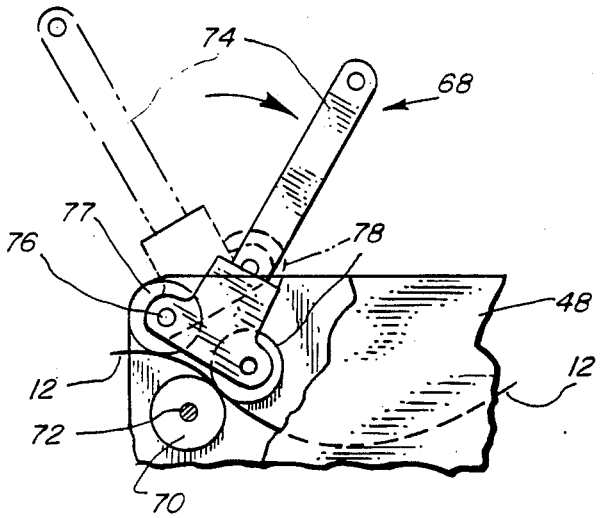
FIG. 7 is an enlarged view of a clamp means usable in the embodiments illustrated.

A pinch roll 116 is provided for each set of plates 110 and 112 (only one being shown) which is supported on spaced brackets 118 extending from the front of the apparatus, the pinch roll comprising a T-shaped lever 120 pivotable about a pivot 122 supporting a roller 123 with a roller 124 at the end of the cross member of the T opposite the pivot 122, and a cooperating feed roller 126 journaled in the brackets 118. Movement of the lever 120 to the rear clamps strip material between the rollers 124 and 126, eliminating the necessity to reband a partially used coil of strip material when the entire coil is not required for production. The clamping means or pinch rolls 116 is essentially the same as that shown in FIG. 7 and the operation is generally the same.

While the rigid plates forming the sides of the coil handling subassemblies have been described and illustrated as being generally L-shaped, such shape is for convenience only; each plate can be rectangular or triangular with means therebetween to support the hub of a coil of material after a quantity of material is removed therefrom.

The appended claims are intended to cover all reasonable equivalents of the structure and are to be interpreted as broadly as the prior art will permit.

We claim:

1. Apparatus for handling coiled strip material and delivering said strip material to a punch press for producing products therefrom, comprising:

a plurality of side-by-side cradle-like coiled strip material supporting means, each having a pair of spaced rigid plates, the spacing between some pairs of plates being different from the spacing between other pairs of plates so as to accommodate different widths of strip material;

a plurality of circularly arranged rollers journaled between each pair of spaced plates to permit a coil of strip material thereon to rotate when a portion is withdrawn;

pinch roll means carried by each pair of spaced plates to restrain the free end of a coil of strip material supported therebetween;

a generally rectangular frame for supporting said plurality of cradle-like coiled strip material supporting means;

each said cradle-like coiled strip material supporting means being removably connected to said frame and being replaceable with another cradle-like coiled strip material supporting means;

roller means on said frame; and means to move said frame and said supported cradle-like coiled strip material means on said roller means to operating position relative to said punch press.

2. Apparatus for handling coiled strip material as recited in claim 1, further comprising rail means on which said roller means roll for moving said coiled strip material to operating position.

3. Apparatus for handling coiled strip material as recited in claim 2, wherein said pinch roll means comprises a pair of rolls, one of which is journaled between a pair of rigid plates and the other of which is pivotable toward said first-named roll, said other roll being mounted on a lever movable between operative and inoperative positions.

* * * * *